US006138684A

United States Patent [19]

Yamazaki et al.

[11] Patent Number: 6,138,684

[45] Date of Patent: Oct. 31, 2000

[54] SMOKING PAPER FOR SMOKING ARTICLE

[75] Inventors: Akira Yamazaki; Kazuko Takeda; Atsunari Hanada; Tomoaki Ogawa, all of Yokohama, Japan

[73] Assignee: Japan Tobacco Inc., Tokyo, Japan

[21] Appl. No.: 08/836,323

[22] PCT Filed: Jun. 14, 1996

[86] PCT No.: PCT/JP96/01630

§ 371 Date: May 7, 1997

§ 102(e) Date: May 7, 1997

[87] PCT Pub. No.: WO97/09483

PCT Pub. Date: Mar. 13, 1997

[30] Foreign Application Priority Data

Sep. 7, 1995 [JP] Japan ..... 7-230218
Jan. 11, 1996 [JP] Japan ..... 8-003224

[51] Int. Cl.[7] ..... A24D 1/02; D21H 11/00; A24B 3/14

[52] U.S. Cl. ..... 131/365; 162/139; 162/181.2; 162/181.8

[58] Field of Search ..... 131/365, 358; 162/139, 181.2, 181.8

[56] References Cited

U.S. PATENT DOCUMENTS

| | | | |
|---|---|---|---|
| 2,733,720 | 2/1956 | Schur | 162/181.2 |
| 3,014,836 | 12/1961 | Proctor | 162/181.2 |
| 3,049,449 | 8/1962 | Allegrini | 131/17 |
| 4,461,311 | 7/1984 | Mathews et al. | 131/365 |
| 4,805,644 | 2/1989 | Hampl, Jr. et al. . | |
| 4,840,705 | 6/1989 | Ikeda et al. | 162/175 |
| 4,998,543 | 3/1991 | Goodman et al. . | |
| 5,109,876 | 5/1992 | Hayden et al. . | |
| 5,123,429 | 6/1992 | Case et al. . | |
| 5,152,304 | 10/1992 | Bokelman et al. . | |
| 5,259,404 | 11/1993 | Case et al. . | |
| 5,376,237 | 12/1994 | Ishiguro et al. | 162/134 |
| 5,450,862 | 9/1995 | Baldwin et al. . | |
| 5,722,433 | 3/1998 | Ishino et al. | 131/365 |

FOREIGN PATENT DOCUMENTS

| | | |
|---|---|---|
| 59-94700 | 5/1984 | Japan . |
| 63-87967 | 4/1988 | Japan . |
| 1-112974 | 5/1989 | Japan . |
| 2-156877 | 6/1990 | Japan . |
| 3-43068 | 2/1991 | Japan . |
| 3-180597 | 8/1991 | Japan . |
| 5-187000 | 7/1993 | Japan . |
| 5-195498 | 8/1993 | Japan . |
| 5-279994 | 10/1993 | Japan . |

*Primary Examiner*—Stanley S. Silverman
*Assistant Examiner*—Jacqueline A. Ruller
*Attorney, Agent, or Firm*—Birch, Stewart, Kolasch & Birch, LLP

[57] ABSTRACT

The paper for rolling a smoking article of the present invention contains particle-form calcium carbonate (30 to 60 wt %), calcined clay (5 to 30 wt %) and pulp. Furthermore, an alkaline metal salt is contained as a chemical additive. In addition, kaolin is contained in the paper. The basis weight of the paper falls within the range of 20 to 70 g/m$^2$. Optical characteristics of the paper and the burning characteristics and ash characteristics of a cigarette are improved and the side stream smoke is reduced.

12 Claims, 1 Drawing Sheet

SMOKING PAPER FOR SMOKING ARTICLE

TECHNICAL FIELD

The present invention relates to a smoking paper for a smoking article capable of reducing side stream smoke.

BACKGROUND ART

At the time of smoking, a main-stream smoke and a side stream smoke are generated from the tobacco. The main stream smoke passes through a cigarette and is inhaled by a smoker. The side stream smoke rises from the distal end of a lighted cigarette.

To reduce the amount of the side stream smoke, additives mentioned below have been added to the cigarette papers for a smoking article, as proposed below.

Jpn. Pat. Appln. KOKAI Publication No. 63-87967 discloses a package web for a smoking article having an outer peripheral surface area of about 8 $m^2$ per $m^2$ of a cigarette paper and containing an additive which contains an alkaline metal salt in an amount of about 15 wt %.

Jpn. Pat. Appln. KOKAI Publication No. 1-112974 discloses a smoking article rolled with paper containing an inorganic metal salt such as aluminium hydroxide or calcium hydroxide.

Jpn. Pat. Appln. KOKAI Publication No. 2-156877 discloses a smoking article rolled with cigarette paper containing calcium sulfate and calcium tartrate in an amount of 1 to 50 wt %.

Jpn. Pat. Appln. KOKAI Publication No. 3-43068 discloses a cigarette paper having a surface area of 20 to 80 $m^2/g$ defined by a BET method and containing calcium carbonate (30 to 40%), a chemical burning agent (2 to 10%), monoammonium phosphate (0 to 1%) and sodium carboxymethyl cellulose (0 to 1%).

Jpn. Pat. Appln. KOKAI Publication No. 3-180597 discloses a cigarette paper containing calcium carbonate (30 wt %) having a surface area of 20 $m^2/g$ or more and an organic acid (0.5 to 12 wt %) such as saccinic acid or malonic acid.

Jpn. Pat. Appln. KOKAI Publication No. 5-279994 discloses a cigarette paper containing secondary particles of calcium carbonate which are an aggregate of primary cubic-form particles of 0.15 $\mu$m or less in diameter.

The conventional cigarette paper developed for reducing a side stream smoke can reduce the side stream smoke. However, it is significantly inferior in other requisite characteristics. For example, the cigarette must not go out even if a burning cigarette is allowed to stand alone and must burn at a desired rate. Such good burning characteristics are required.

The cigarette paper must have color and transparency satisfying a smoker's taste. Particularly, white is the most favorable color for the cigarette paper. It is desirable that the cigarette paper be as white as possible and low in transparency.

As is described above, the cigarette paper must be excellent not only in the effect of reducing the side stream smoke but also in all characteristics including optical characteristics of the cigarette paper and burning characteristics of the cigarette. More preferably, the ash of a cigarette left after burning must have an adhesive characteristic to, hold its shape and prevent scattering, and, must be white. The cigarette paper is desired to also have such ash characteristics mentioned above.

However, any of the aforementioned conventional techniques for reducing the side stream smoke has not yet succeeded in providing the cigarette paper excellent in all characteristics.

Not only a smoker but also non smokers around the smoker are made uncomfortable with the side stream smoke. Therefore, it is desired that the reduction of the side stream smoke be visually recognized even by the passive smokers. Hitherto, the reduction of the side stream smoke generated by smoking a cigarette has been studied. However, the reduction of the side stream smoke visually observed by the passive smokers has not yet been studied.

DISCLOSURE OF INVENTION

The present invention has been made in view of the aforementioned problems. The present invention is directed to a cigarette paper capable of reducing a side stream smoke and excellent in optical characteristics, burning characteristics and ash characteristics.

More specifically, according to a first aspect of the present invention, there is provided cigarette paper for a smoking article characterized by containing 30 to 60% by weight of calcium carbonate, 5 to 30% by weight of calcined clay and pulp.

According to a second aspect of the present invention, there is provided cigarette paper for a smoking article characterized by containing 10 to 60% by weight of calcium carbonate, 5 to 30% by weight of calcined clay, 0.5 to 10% by weight of a chemical additive consisting of an alkaline metal salt and pulp.

According to a third aspect of the present invention, there is provided cigarette paper for a smoking article, characterized by containing 2 to 30% by weight of kaolin and pulp.

According to a fourth aspect of the present invention, there is provided cigarette paper for rolling a smoking article characterized by containing 2 to 30% by weight of kaolin, 5 to 30% by weight of calcined clay, 0.3 to 10% by weight of a chemical additive comprising an alkaline metal salt, and pulp.

According to a fifth aspect of the present invention, there is provided cigarette paper for a smoking article characterized by containing 30 to 60% by weight of calcium carbonate, 5 to 30% by weight of calcined clay, 2 to 10% by weight of kaolin, and pulp.

According to a sixth aspect of the present invention, there is provided cigarette paper for a smoking article comprising 10 to 60% by weight of calcium carbonate, 5 to 30% by weight of calcined clay, 0.5 to 10% by weight of a chemical additive comprising an alkaline metal salt, and pulp.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWING

The present invention will become more fully understood from the detailed description given hereinbelow and the accompanying drawings which are given by way of illustration only, and thus are not limitative of the present invention, and wherein.

BEST MODE OF CARRYING OUT THE INVENTION

Figure 1:
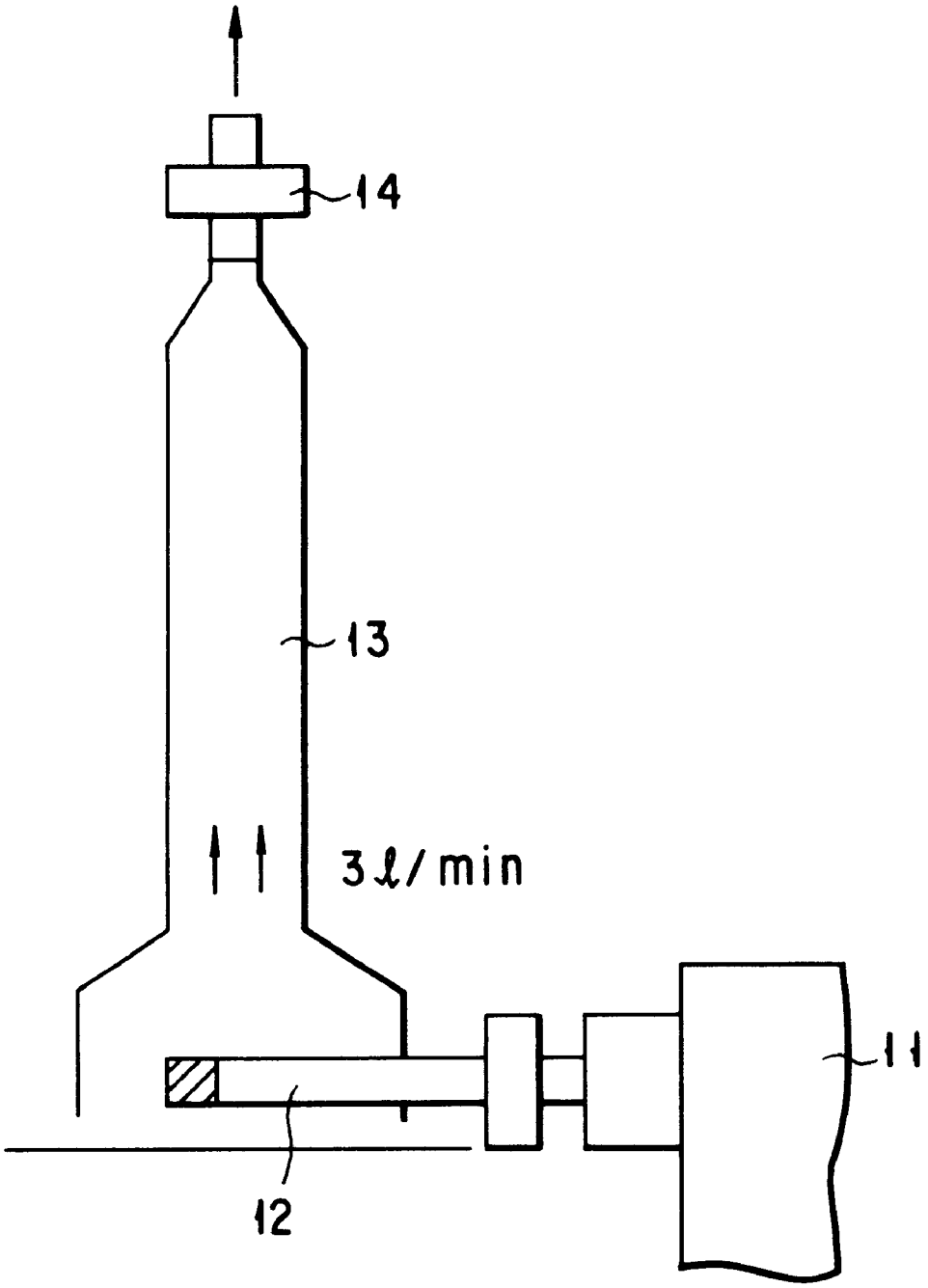
FIG. 1 is an illustration of an apparatus for measuring the amount of tar contained in a side stream smoke for the use of experiments for demonstrating effects of the present invention.

Hereinbelow, the present invention will be described in detail.

The present inventors have intensively studied with a view toward overcoming the aforementioned problems. As a result, they found that a side stream smoke can be effectively reduced by a cigarette paper made of pulp alone. In other words, it was found that the cigarette rolled with the cigarette paper made of a pulp containing no filler generates a lower amount of the side stream smoke than the cigarette rolled with the cigarette paper, such as a commercially available general cigarette paper, made of pulp containing a generally used filler.

However, sufficient optical characteristics, burning characteristics, and ash characteristics are not provided by pulp alone. Therefore, it appeared that the filler must be added. Calcium carbonate ($CaCO_3$) has been studied as a possible filler. As a result, it was found that the side stream smoke reducing effect intrinsic to pulp can be maintained even if calcium carbonate is added to pulp. However, calcium carbonate seldom contributes to improving the optical characteristics of the cigarette paper and burning characteristics of the cigarette. Of the ash characteristics, color was slightly improved by the addition of calcium carbonate. The adhesion of the ash was improved by adding a large amount of calcium carbonate but the improvement is not sufficient.

On the other hand, the optical characteristics, burning characteristics, and ash characteristics are improved by adding only a calcined clay to pulp, compared to the cigarette paper made of pulp alone with no filler. However, the side stream smoke increased and a reduction rate of the side stream smoke decreased.

The present inventors found that the side stream smoke reducing effect intrinsic to pulp can be maintained or improved. At the same time, the optical characteristics, burning characteristics, and ash characteristics of a cigarette paper can be improved, by adding both calcium carbonate and calcined clay to the cigarette paper.

The cigarette paper according to a first aspect of the present invention is characterized by containing 30 to 60 wt % of calcium carbonate, 5 to 30 wt % of calcined clay, and pulp.

The calcium carbonate to be used in the cigarette paper according to the invention of the first aspect, is added in an amount of 30 to 60 wt % based on the overall weight of the cigarette paper after making the paper. This is because if the content is less than 30 wt %, it cannot prevent the side stream smoke reducing effect from decreasing. If the content exceeds 60 wt %, the strength (tensile strength) of the paper will decrease significantly.

Calcium carbonate used in the first aspect of the present invention takes particle form. The form of calcium carbonate particles is not particularly limited. However, the primary calcium carbonate particles are preferred to be a rhombohedral form. The rhombohedral form particles used herein are present substantially in the form of a square, and have an aspect ratio of 5 or less. Such primary particles are aggregated into secondary particles, which are also included in the scope of the calcium carbonate particles.

The size of calcium carbonate particles is not particularly limited and may fall within the range of 0.03 to 0.15 $\mu$m.

The calcined clay to be added to the cigarette paper of the present invention is formed by subjecting clay to heat treatment. The clay is a naturally-occurring particulate material obtained from the earth and constituting a crystalline mineral known as a clay mineral.

There are two types of calcined clays, a partially-calcined clay and a completely-calcined clay. The partially calcined clay is formed by treating clay with heat at 600 to 700° C. to remove intra-molecular hydroxyl groups. On the other hand, the completely calcined clay is formed by calcining clay at a temperature from 1000 to 1050° C.

The calcined clay is added in an amount of 5 to 30 wt % based on the overall weight of the cigarette paper after being manufactured. This is because if the content is less than 5 wt % or less, sufficient optical characteristics of the cigarette paper, sufficient burning characteristics and ash characteristics of the cigarette cannot be obtained. On the other hand, if the content exceeds 30 wt %, the optical characteristics, burning characteristics and ash characteristics cannot be improved any further.

The pulp used in the cigarette paper of the present invention is not limited as long as it is employed in a cigarette paper for a general smoking article. Examples of the cigarette paper include linen pulp, hardwood pulp, softwood pulp, non-wood pulp such as hemp or the like, or a mixture thereof.

The beating degree of the pulp employed herein is not particularly limited. The beating degree is preferred to be large in any pulp, because the side stream smoke reducing effect increases as the beating degree increases. For example, the linen pulp having a high beating degree is preferable as long as it falls within the range of a modified Canadian standard freeness of 55 to 180 ml. In other words, it is preferred that the linen pulp have a small modified Canadian standard freeness. The modified Canadian standard freeness is a value of freeness per gram of pulp by absolute dry weight, measured by replacing a sieve used in a Canadian standard freeness tester with an 80 mesh bronze wire. As described above, a preferable range of the beating degree varies depending on types of pulp. In any type of pulp, as the beating degree becomes larger, the side stream smoke decreases.

The basis weight of the cigarette paper according to a first aspect of the present invention is not particularly limited as long as it falls within the range suitable for a general cigarette paper. To be more specific, the cigarette paper after being manufactured has a basis weight of 20 to 70 g/m$^2$. In particular, when the basis weight is within 50 to 70 g/m$^2$, the side stream smoke reducing effect is more excellent.

To the cigarette paper according to the first aspect of the present invention, one or two or more types of chemical additives mainly comprising an alkaline metal salt, may be added. When the chemical additive is added, not only the side-stream smoke reducing effect but also the ash characteristics can be further improved. When the chemical additive is used, the cigarette paper has a sufficient side stream smoke reducing effect even if the content of calcium carbonate is 10 wt %. The content of the chemical additive falls within the range of 0.5 to 10 wt % based on the overall weight of the cigarette paper after being manufactured. When the content is less than 0.5 wt %, the side steam smoke reducing effect cannot be improved. On the other hand, if the content exceeds 10 wt %, the side steam smoke reducing effect and the ash characteristics cannot be improved any further. On the contrary, the burning characteristics and smoking flavor and taste may deteriorate.

The chemical additive mainly made of an alkaline metal salt is selected from the group consisting of sodium salts and potassium salts of carbonic acid, formic acid, acetic acid, propionic acid, malic acid, lactic acid, glycolic acid, citric acid, tartaric acid, fumaric acid, succinic acid, oxalic acid, malonic acid and phosphoric acid. The chemical additive is added in a paper making step using a paper machine. More specifically, the addition of the chemical additive is performed by the steps of preparing a raw paper material from pulp, a filler, and a large amount of water, removing water from the raw paper material on the wire of the paper making machine, coating an aqueous solution containing the chemical additive over the resultant raw paper material, and drying the paper material thus obtained. The addition of the chemical additive is alternatively performed in a processing step after the paper making step by coating the chemical additive dissolved in water or an organic solvent and drying the resultant paper material.

The cigarette paper of the present invention may contain a filler or an additive generally used in the cigarette paper other than those mentioned above. As the filler, magnesium carbonate and titanium oxide may be mentioned. Examples of the additives may include ammonium phosphate, aluminium sulfate, sodium carbonate, carboxymethyl cellulose, and the like.

Furthermore, the present inventors found that the optical characteristics of the cigarette paper and burning characteristics of the cigarette can be improved by adding kaolin to pulp while maintaining the side stream smoke reducing effect intrinsic to pulp.

The cigarette paper according to the second aspect of the present invention is characterized by containing 2 to 30 wt % of kaolin and pulp.

The composition of kaolin to be added to the cigarette paper according to the second aspect of the present invention is represented by $Al_2SiO_5(OH)_4$ or $Al_2O_3 \cdot 2SiO_2 \cdot 2H_2O$. Kaolin is added in an amount of 2 to 30 wt %, preferably 2 to 10 wt % based on the overall amount added to the cigarette paper after the paper making. This is because if the content is less than 2 wt % or less, an improvement of burning characteristics cannot be expected. On the other hand, if the content exceeds 30 wt %, the smoking flavor and taste may deteriorate.

The pulp used in the cigarette paper according to the second aspect of the present is the same as that used in the first aspect of the present invention.

To the cigarette paper according to a second aspect of the present invention, one or two types of chemical additives mainly comprising an alkaline metal salt, may be added. Not only the side steam smoke reducing effect but also the ash characteristics are further improved by the addition of the chemical additives.

The content of the chemical additive is 0.3 to 10 wt % based on the overall amount of the cigarette paper after manufactured by a paper machine, thus after being the paper making. This is because if the content is less than 0.3 wt %, the side steam smoke reducing effect cannot be improved any further. On the other hand, if the content exceeds 10 wt %, the side stream smoke reducing effect and ash characteristics cannot be improved any further. On the contrary, the burning characteristics and the smoking flavor and taste may deteriorate. The chemical additive mainly consisting of an alkaline metal salt is the same as that used in the first aspect of the present invention.

To the cigarette paper of the second aspect of the present invention, additives generally used in the cigarette paper may be added other than the additives mentioned above.

To the cigarette paper according to a second aspect of the present invention, a calcined clay and one or two or more chemical additives mainly comprising an alkaline metal salt, may be added. The calcined clay is the same as explained in the first invention. The calcined clay is added in an amount within the range of 5 to 30 wt % based on the overall amount of the cigarette paper after the paper making, in the same manner as in the first aspect of the present invention. This is because if the content is less than 5 wt %, sufficient optical characteristics of the cigarette paper and sufficient burning characteristics and ash characteristics of the cigarette cannot be obtained. On the other hand, if the content exceeds 30 wt %, the optical characteristics, burning characteristic and ash characteristics cannot be improved any further.

In this case, additives generally used in the cigarette paper may be used other than the additives mentioned above.

The optical characteristics of the cigarette paper and burning characteristics and ash characteristics of the cigarette can be improved, at the same time, the side stream smoke reducing effect intrinsic to pulp can be maintained, by using both kaolin and calcined clay, and further adding the chemical additive thereto.

The basis weight of the cigarette paper according to the second aspect of the present invention may fall within the range of the basis weight of usually used cigarette paper. To describe more specifically, the cigarette paper obtained after manufacturing has a basis weight of 20 to 70 g/m$^2$. In particular, when the basis weight is 50 to 70 g/m$^2$, more excellent side stream smoke reducing effect can be obtained.

As a marker indicating the reduction of the side stream smoke and easily recognized by a smoker and non smokers, the present inventors paid attention to the amount of the side stream smoke per unit time. In an attempt to reduce the amount of the side stream smoke per unit time, the present inventors tried to use kaolin together with calcium carbonate and calcined clay, since kaolin has an excellent side stream smoke reducing effect and relatively low burning characteristics among the materials to be used in the fillers or additives. As a result, they found that if calcium carbonate, calcined clay and kaolin are used together, the following improvements are obtained:

- improving optical characteristics of the cigarette paper;
- improving a side stream smoke reducing effect intrinsic to pulp;
- suppressing the amount of the visual side stream smoke by reducing the amount of the side stream smoke per unit time which can be accomplished from the burning rate reduction; and
- improving ash characteristics of the cigarette.

The cigarette paper according to the third aspect of the invention is characterized by containing 30 to 60 wt % of a calcium carbonate, 5 to 30 wt % of a calcined clay, 2 to 10 wt % of kaolin, and pulp.

Calcium carbonate used in the cigarette paper according to a third aspect of the present invention is the same as that used in the invention according to the first aspect.

Calcium carbonate is contained in an amount of 30 to 60 wt % based on the overall amount of the cigarette paper after the paper making. This is because if the content is less than 30 wt %, it is not possible to prevent reduction of the side stream smoke reducing effect by the addition of calcined clay. If the content exceeds 60 wt %, the strength (tensile strength) of the paper significantly decreases.

The calcined clay used in the cigarette paper according to the third aspect of the present invention is the same as used in the invention of the first aspect. The calcined clay is contained within the range of 5 to 30 wt % based on the overall amount of the cigarette paper after manufactured by a paper machine. This is because if the content is less than 5 wt %, the sufficient optical characteristics of the cigarette paper and sufficient burning characteristics and ash characteristics of cigarette cannot be obtained. On the other hand, if the content exceeds 30 wt %, the optical characteristics, burning characteristics, and ash characteristics cannot be improved any further.

Kaolin used in the cigarette paper according to the third aspect of the present invention is contained in an amount of 2 to 30 wt %, preferably in an amount of 2 to 10 wt % based on the overall amount of the cigarette paper after the paper making. This is because if the content is less than 2 wt %, the side stream smoke reducing effect per unit time cannot be improved any further. If the content exceeds 30 wt %, smoking flavor and taste may deteriorate.

The pulp used in the cigarette paper according to the third aspect of the present invention is the same as that used in the invention of the first aspect.

To the cigarette paper according to the third aspect of the present invention, one or two or more chemical additives mainly comprising an alkaline metal salt, may be added. Not only the side stream smoke reducing effect but also the ash characteristics of the cigarette can be further improved by the addition of the chemical additive. In the case where a chemical additive is used, a sufficient side stream smoke reducing effect can be obtained even if calcium carbonate is added in an amount of 10 wt %. The content of the chemical additive falls within the range of 0.5 to 10 wt % based on the overall amount of the cigarette paper after the paper making. This is because if the content is less than 0.5 wt %, the side stream smoke reducing effect cannot be improved. On the other hand, if the content exceeds 10 wt %, the side stream smoke reducing effect and ash characteristics cannot be improved any further. The smoking flavor and taste of the cigarette deteriorate. The chemical additive mainly consisting of an alkaline metal salt is the same as used in the invention of the first aspect.

The cigarette paper according to the third aspect of the present invention may contain a filler or an additive generally used in the cigarette paper other than those mentioned above.

EXAMPLES

Hereinbelow, we will explain experiments for confirming the effects of the paper for rolling a smoking article, i.e., the cigarette paper, of the present invention. In the experiments described below, the manufacturing of test cigarette papers and various evaluations were performed as follows.

[Producing of Cigarette Paper]

Linen pulp was beaten so as to obtain a modified Canadian standard freeness of 65 ml. The modified Canadian standard freeness used herein refers to a value of freeness per gram of pulp (by absolute dry weight) measured by replacing a sieve used in a Canadian standard freeness tester with an 80 mesh bronze wire. On the other hand, a hardwood kraft pulp (LBKP) was beaten so as to obtain a modified Canadian standard freeness of 250 ml. The modified Canadian standard freeness used herein refers to a value of freeness per 3 g of pulp (by absolute dry weight) measured by replacing a sieve used in a Canadian standard freeness tester with an 80 mesh bronze wire.

The linen pulp and LBKP thus obtained were mixed in the weight ratio of 8:2 to prepare a pulp mixture. To the pulp mixture, calcium carbonate and calcined clay (yield in the United State and manufactured by Huber under the trade name of Hycal) were added in addition amounts shown in Tables 1 to 3. Thereafter, test cigarette papers 1 to 15 having basis weights shown in Tables 1 to 3 were produced from the above-obtained pulp mixtures, by means of a TAPPI standard hand-making paper machine.

To the pulp mixture, calcium carbonate and calcined clay were added in addition amounts shown in Tables 4 and 5. After cigarette papers having basis weights shown in Tables 4 and 5 were produced in the same manner as above, a citric acid salt was added in addition amounts shown in Tables 4 and 5. As a result, test cigarette papers 16 to 27 were obtained.

On the other hand, linen pulp was beaten to obtain a modified Canadian standard freeness of 65 ml. To the resultant pulp, kaolin (yielded in the United State and manufactured by Huber under the trade name of Hydragloss 90) was added in addition amounts shown in Table 6. Thereafter, test cigarette papers No. 28 to 33 having a basis weight of 25 g/m$^2$ were produced from the above-obtained pulp mixtures, by means of a TAPPI standard hand-making paper machine.

To the linen pulp, kaolin was added in addition amounts shown in Table 7. After cigarette papers having a basis weight of 25 g/m$^2$ were produced from the resultant pulp mixtures by means of a TAPPI standard hand-making paper machine, a citric acid salt was added in addition amounts shown in Table 7. As a result, test cigarette papers 30-1 to 30-3, 31-1 to 31-8, and 33-1 to 33-3 were obtained.

Furthermore, to the linen pulp, kaolin and calcined clay (yielded in the United State and produced by Huber under the trade name of Hycal) were added in addition amounts shown in Table 8. After cigarette papers having a basis weight of 25 g/m$^2$ were produced from the resultant pulp mixtures by means of a TAPPI standard hand-making paper machine, a citric acid salt was added in addition amounts shown in Table 8, if necessary. As a result, test cigarette papers 34*a* to 37*a*, 34*b* to 37*b* were obtained.

To the linen pulp mentioned above, calcium carbonate, calcined clay, and kaolin were added in addition amounts shown in Table 9. Thereafter, test cigarette papers 38*a* to 41*a* having a basis weight of 45 g/m$^2$ were produced from the above-obtained pulp mixtures, by a TAPPI standard hand-making paper machine. To these test cigarette papers 38*a* to 41*a*, 2.0 and 4.0 wt % of a citric acid salt were added. As a result, test cigarette papers 38*b* to 41*b* and 38*c* to 41*c* were obtained.

As a control, use was made of a commercially available general cigarette paper containing scalenohedral form calcium carbonate of about 0.3 $\mu$m in diameter in an amount of 26% as a filler.

[Evaluation of Optical Characteristics]

Of the optical characteristics of the test cigarette papers, the brightness and opacity were measured by a Photovolt reflection meter.

The brightness was obtained on the basis of specific reflectivity of light passing through a filter with main wavelength of 457 nm relative to a standard magnesium oxide board.

The opacity was obtained on the basis of the ratio of reflectivity obtained when light passing through a green filter with a main wavelength of 570 nm was directed onto a sample backed with a white body to the reflectivity obtained when the aforementioned light was directed onto a sample backed with a black body.

[Producing of Test Cigarette]

Commercially available tobacco shreds were rolled with the test cigarette paper under the following conditions:

| | |
|---|---|
| Length | 59 mm |
| Circumference: | 25 mm |
| Roll Weight: | 0.695 g |

[Measurement for Side stream Smoke per Cigarette]

Test cigarettes having a roll weight of 0.695±0.02 g and an average air-flow resistance of the cigarette roll ±5 mm $H_2O$, were selected from the test cigarettes mentioned above. Thereafter, the amount of tar contained in the side stream smoke was measured in accordance with a fishtail method. To be more specific, a test cigarette 12 was fixed to a smoking machine 11, as shown in FIG. 1 and allowed to burn until the burning length reached 40 mm under the standard smoking conditions suction of 35 cc for two seconds was made one time per minute, a cigarette was allowed to stand for the remaining 58 seconds, while the side stream smoke was being sucked by use of the fishtail-form collector 13 at a rate of 3 liter/minute. The weight of the particle-phase constituent of the side stream smoke attached onto the Cambridge filter 14 was calculated by measuring the difference in weight of a Cambridge filter 14 being 44 mm in diameter, which was provided to the distal end of the fishtail-form collector 13 in the suction direction. On the other hand, the particle-phase constituent attached on the Cambridge filter 14 and attached to the inner side wall of the fishtail-form collector 13 were separately extracted. The absorbency of the extracts was measured. Based on the ratio of the absorbency values thus obtained and the calculated weight of the particle-phase constituent of the side stream smoke attached to the Cambridge filter 14, the weight of the particle phase constituent attached on the inner side wall of the fishtail-form collector 13, was calculated. The sum of the weight of the particle-phase constituent of the side stream smoke attached on the Cambridge filter 14 added to the weight of the particle-phase constituent attached on the inner wall of the fishtail-form collector 13 was defined as the amount of side stream smoke per cigarette (mg/cig). In addition, a reduction rate(%) of the side stream smoke per each of the test cigarettes was obtained on the basis of a control cigarette which was rolled with a commercially available general cigarette paper in the same manner as mentioned above.

[Evaluation of Burning Time]

Burning time (second) was defined as the time from the initialization of the burning to a time point at which a burning length reached 40 mm, when the side stream smoke was measured. The air permeability of the test cigarette paper was 1–2 Coresta unit in this experiment, so that the flow-in amount of air through the cigarette paper was negligibly low, indicating that no difference in the burning length of test cigarettes is present at the time of suction. Hence, the aforementioned method was employed.

[Evaluation of the Side stream Smoke per Unit time]

The amount of the side stream smoke/cigarette (mg/cig) measured by the aforementioned method was divided by the burning time. The quotient was defined as the amount of the side stream amount per unit time (mg/sec). The reduction rate (%) of the side stream smoke per unit time was obtained on the basis of the control cigarette which was a cigarette rolled with a commercially-available general cigarette paper in the same manner mentioned above.

[Evaluation of Burning Characteristics]

Burning characteristics were assessed by use of the side stream smoke measuring apparatus mentioned above. A test cigarette 12 was fixed to the smoking machine 11 shown in FIG. 1. A cigarette is lit when suction of 35 cc for two seconds was made by use of the smoking machine 11. Thereafter no suction was made. Then, the side stream smoke was sucked by use of a fishtail-form collector 13 at a rate of 3 liter/minute. Under these conditions, the case where a burning length reached 40 mm was scored "good" (◎). The case where the burning length did not reach 40 mm was scored "not good" (X).

[Evaluation of Ash Characteristics]

The test cigarettes were allowed to smoke by the smoking machine at certain intervals under the standard smoking conditions. Before dropping due to its own weight, the ash was collected on a Petri dish and placed on a gray background. In this state, the differences in whiteness and adhesive properties of the ash between test cigarettes and the control cigarette were evaluated by 10 panels and scored as follows:

| | |
|---|---|
| +3 | very good |
| +2 | good |
| +1 | rather good |
| 0 | no difference observed |
| −1 | rather bad |
| −2 | bad |
| −3 | very bad |

Since the appearance of the ash was influenced by the adhesive characteristics of the ash, the whiteness was evaluated by observing individual constituents of ash, not by observing the whole shape of the cigarette butt. The aforementioned experiment was repeated three times. An average of the total scores was obtained for each test sample. The case where the total average was 0 or more, was indicated by ◎. The case where the total average was 0 to −1.5, was indicated by Δ. The case where the total average was −1.5 to −3 was indicated by X. The obtained data were subjected to variance analysis (two-way classification, repeated for three times) with respect to each sample and each panel. The difference between the samples and panels were examined. At the same time, whether or not significant difference is present between samples was examined.

Results:

First, the results of experiments using cigarette papers containing only calcium carbonate are shown in Table 1. The calcium carbonate particles used herein are rhombohedral form micro particulates of about 0.05 $\mu$m in diameter.

TABLE 1

| Sample No. | Basis weight ($g/m^2$) | Filler content $CaCO_3$ (%) | Optical characteristics Brightness (%) | Optical characteristics Opacity (%) | Side stream smoke/cigarette mg/cig | Side stream smoke/cigarette Reduction rate (%) |
|---|---|---|---|---|---|---|
| 1 | 25 | 0 | 78.0 | 60.1 | 12.6 | 20.3 |
| 2 | 25 | 1 | 76.6 | 52.9 | 12.7 | 19.7 |
| 3 | 25 | 3 | 75.6 | 53.6 | 12.7 | 20.9 |
| 4 | 25 | 5 | 76.5 | 56.2 | 12.3 | 22.2 |
| 5 | 25 | 10 | 76.3 | 57.8 | 12.7 | 19.7 |
| 6 | 25 | 30 | 82 | 63 | 13.6 | 13.9 |
| Control | 21 | 26 | 87 | 81 | 15.8 | 0 |

| Sample No. | Burning characteristics | Ash characteristics Color | Ash characteristics Adhesion | Burning time (sec.) | Side stream smoke/sec. mg/sec | Side stream smoke/sec. Reduction rate (%) |
|---|---|---|---|---|---|---|
| 1 | x | x | x | 840 | 0.0150 | 70.1 |
| 2 | x | x | Δ | 814 | 0.0156 | 68.9 |
| 3 | x | x | Δ | 774 | 0.0164 | 67.3 |

TABLE 1-continued

| | | | | | | |
|---|---|---|---|---|---|---|
| 4 | x | Δ | Δ | 755 | 0.0163 | 67.5 |
| 5 | x | Δ | ○ | 713 | 0.0178 | 64.5 |
| 6 | x | Δ | ○ | 553 | 0.0246 | 51.0 |
| Control | ◎ | ◎ | ◎ | 315 | 0.0502 | 0 |

As is apparent from Table 1, it was found that the side stream smoke reducing effect intrinsic to pulp can be maintained when only calcium carbonate is added to the cigarette papers. However, calcium carbonate seldom contributed to improving the optical characteristics of the cigarette papers and the burning characteristics of the cigarette. Of the ash characteristics, the whiteness was slightly improved but the improvement was not sufficient. The improvement of the binding properties was observed by adding a relatively large amount of calcium carbonate, but the improvement was not satisfactory.

Table 2 shows the results of experiments using cigarette papers containing only calcined clay. The calcined clay used herein is a completely-calcined clay.

TABLE 2

| | Basis | Filler content | Optical characteristics | | Side stream smoke/cigarette | |
|---|---|---|---|---|---|---|
| Sample No. | weight ($g/m^2$) | Calcined clay (%) | Brightness (%) | Opacity (%) | mg/cig | Reduction rate (%) |
| 1 | 25 | 0 | 78.0 | 60.1 | 12.6 | 20.3 |
| 7 | 25 | 10 | 84 | 78 | 17.7 | −4.1 |
| 8 | 25 | 30 | 88 | 83 | 18.6 | −9.4 |
| Control | 21 | 26 | 87 | 81 | 15.8 | 0 |

| | Burning | Ash characteristics | | Burning | Side stream smoke/sec. | |
|---|---|---|---|---|---|---|
| Sample No. | character-istics | White-ness | Adhesion | time (sec.) | mg/sec | Reduction rate (%) |
| 1 | x | x | x | 840 | 0.0150 | 70.1 |
| 7 | ◎ | Δ | ○ | 370 | 0.0478 | 4.8 |
| 8 | ◎ | Δ | ○ | 308 | 0.0605 | −20.0 |
| Control | ◎ | ◎ | ◎ | 315 | 0.0502 | 0 |

As is apparent from Table 2, improvements in the optical characteristics of the cigarette papers and the burning characteristics and ash characteristics of the cigarette were observed by the addition of the calcined clay. On the contrary, the amount of the side stream smoke per cigarette increased and its reduction rate of the side stream smoke decreased.

Table 3 shows the results of experiments using cigarette papers containing calcium carbonate (a rhombohedral form micro particulates of about 0.05 $\mu$m diameter) and calcined clay. The content of the calcined clay used herein was set to 10 wt % in consideration of the results of Sample No. 7 in Table 2, which exhibited improvements in the optical characteristics and the burning characteristics and the ash characteristics of the cigarette.

Three types of the cigarette papers were used which had basis weights of the cigarette papers after making paper of 25 $g/m^2$ (Sample Nos. 9 to 13), 45 $g/m^2$ (Sample No. 14), and 55 $g/m^2$ (Sample No. 15).

TABLE 3

| | | Filler content | | Optical characteristics | | Side stream smoke/cigarette | |
|---|---|---|---|---|---|---|---|
| Sample No. | Basis weight ($g/m^2$) | Cal-cined clay (%) | $CaCO_3$ (%) | Bright-ness (%) | Opacity (%) | mg/cig | Re-duction rate (%) |
| 9 | 25 | 10 | 10 | 83 | 79 | 16.1 | 5.3 |
| 10 | 25 | 10 | 20 | 83 | 79 | 15.4 | 9.4 |
| 11 | 25 | 10 | 30 | 83 | 79 | 13.9 | 18.3 |
| 12 | 25 | 10 | 50 | 83 | 79 | 13.0 | 23.9 |
| 13 | 25 | 10 | 60 | 84 | 80 | 12.4 | 27.9 |
| 14 | 45 | 10 | 30 | 84 | 87 | 11.3 | 33.4 |
| 15 | 55 | 10 | 30 | 84 | 89 | 10.3 | 39.5 |
| Control | 21 | 0 | 26 | 86 | 80 | 17.0 | 0 |

| | Burning | Ash characteristics | | Burning | Side stream smoke/sec. | |
|---|---|---|---|---|---|---|
| Sample No. | character-istics | White-ness | Adhesion | time (sec.) | mg/sec | Reduction rate (%) |
| 9 | ◎ | ○ | ○ | 356 | 0.0452 | 18.3 |
| 10 | ◎ | ○ | ○ | 339 | 0.0454 | 17.9 |
| 11 | ◎ | ◎ | ◎ | 319 | 0.0436 | 21.2 |
| 12 | ◎ | ◎ | ◎ | 299 | 0.0435 | 21.3 |
| 13 | ◎ | ◎ | ◎ | 290 | 0.0428 | 22.6 |
| 14 | ◎ | ◎ | ◎ | 294 | 0.0384 | 30.6 |
| 15 | ◎ | ◎ | ◎ | 291 | 0.0354 | 36.0 |
| Control | ◎ | ◎ | ◎ | 307 | 0.0553 | 0 |

As is apparent from Table 3, in the cigarette papers of Sample Nos. 11 to 13 containing 10 wt % of the calcined clay and 30 to 60 wt % of calcium carbonate, the amount of side stream smoke per cigarette was reduced to the level similar to or below that of the cigarette paper of Sample No. 1 made of only pulp. In addition, the cigarette papers of Samples 11 to 13 were excellent in all characteristics including optical characteristics of the cigarette papers and the burning characteristics and ash characteristics of the cigarette. It was further found that when the samples have the same contents of calcium carbonate, the cigarette papers (Sample Nos. 14 to 15) having a higher basis weight than the cigarette papers (Sample No. 11), exhibit a higher side stream smoke reducing effect per cigarette.

Table 4 shows the results of experiments using cigarette papers containing calcium carbonate and calcined clay, and a citric acid salt serving as a chemical additive which consists of sodium citrate and potassium citrate in a ratio of 1:1 (hereinafter, referred to as "citric acid salt"). In the experiments, the contents of calcium carbonate and calcined clay were set to the same as those of Sample No. 10 in which sufficient side stream smoke reducing effect and ash characteristics were not obtained (refer to Table 3).

TABLE 4

| | Basis | Filler content | | Citric acid salt (Na, K) | Side stream smoke/cigarette | |
|---|---|---|---|---|---|---|
| Sample No. | weight ($g/m^2$) | Calcined clay (%) | $CaCO_3$ (%) | content (%) | mg/cig | Reduction rate (%) |
| 10 | 25 | 10 | 20 | 0 | 15.9 | 5 |
| 16 | 25 | 10 | 20 | 1 | 12.4 | 26 |
| 17 | 25 | 10 | 20 | 2 | 11.5 | 32 |
| 18 | 25 | 10 | 20 | 4 | 10.7 | 36 |
| 19 | 25 | 10 | 20 | 6 | 11.0 | 35 |
| 20 | 25 | 10 | 20 | 10 | 11.0 | 35 |
| Control | 21 | 0 | 26 | 1.2 | 16.8 | 0 |

TABLE 4-continued

| Sample No. | Burning characteristics | Ash characteristics: Whiteness | Ash characteristics: Adhesion | Burning time (sec.) | Side stream smoke/sec.: mg/sec | Side stream smoke/sec.: Reduction rate (%) |
|---|---|---|---|---|---|---|
| 10 | ◎ | ○ | ○ | 316 | 0.0503 | 11.6 |
| 16 | ◎ | ◎ | ◎ | 311 | 0.0399 | 29.9 |
| 17 | ◎ | ◎ | ◎ | 290 | 0.0397 | 30.2 |
| 18 | ◎ | ◎ | ◎ | 275 | 0.0398 | 30.1 |
| 19 | ◎ | ◎ | ◎ | 272 | 0.0404 | 29.0 |
| 20 | ◎ | ◎ | ◎ | 274 | 0.0401 | 29.5 |
| Control | ◎ | ◎ | ◎ | 295 | 0.0569 | 0 |

As is apparent from Table 4, in the case of cigarette papers (Sample No. 16 to 20) containing a citric acid salt in an amount of 1 to 10 wt %, the side stream smoke reducing effect per cigarette and the ash characteristics were improved, compared to the cigarette paper (Sample No. 10) containing no citric acid salt. From the result, it was found that the side stream smoke per cigarette is significantly reduced by addition of the citric acid salt to the samples whose calcium carbonate is as low as 20 wt %, compared to the cigarette paper made of only pulp (Sample No. 1). Furthermore, by the addition of the citric acid salt, the cigarette papers (Nos. 16 to 20) excellent in all characteristics including the optical characteristics and burning characteristics and ash characteristics can be obtained.

FIG. 5 shows the results of experiments using cigarette papers containing calcium carbonate, calcined clay, and a citric acid salt. The content of calcium carbonate was varied within the range of 10 to 60 wt %. The contents of calcined clay and citric acid salt used herein were set to 10 wt % and 2 wt %, respectively.

Three types of the cigarette papers were used having basis weights (of the cigarette papers produced by a hand-making paper machine) of 25 g/m$^2$ (Sample Nos. 20 to 24), 45 g/m$^2$ (Sample No. 25), and 55 g/m$^2$ (Sample No. 26).

TABLE 5

| Sample No. | Basis weight (g/m$^2$) | Filler content (%): Calcined clay | Filler content (%): $CaCO_3$ | Citric acid salt (Na, K) content (%) | Optical characteristics: Whiteness (%) | Optical characteristics: Opacity (%) | Side stream smoke/cigarette: mg/cig | Side stream smoke/cigarette: Reduction rate (%) |
|---|---|---|---|---|---|---|---|---|
| 21 | 25 | 10 | 10 | 2 | 83 | 79 | 13.0 | 23.6 |
| 22 | 25 | 10 | 20 | 2 | 83 | 79 | 13.6 | 20.2 |
| 23 | 25 | 10 | 30 | 2 | 83 | 79 | 12.9 | 24.6 |
| 24 | 25 | 10 | 50 | 2 | 83 | 79 | 10.9 | 36.1 |
| 25 | 25 | 10 | 60 | 2 | 84 | 80 | 10.2 | 39.9 |
| 26 | 45 | 10 | 30 | 2 | 84 | 87 | 9.1 | 46.7 |
| 27 | 55 | 10 | 30 | 2 | 84 | 89 | 8.8 | 48.5 |
| Control | 21 | 0 | 26 | 1.2 | 86 | 80 | 17.0 | 0 |

| Sample No. | Burning characteristics | Ash characteristics: Whiteness | Ash characteristics: Adhesion | Burning time (sec.) | Side stream smoke/sec.: mg/sec | Side stream smoke/sec.: Reduction rate (%) |
|---|---|---|---|---|---|---|
| 21 | ◎ | ◎ | ◎ | 306 | 0.0424 | 25.0 |
| 22 | ◎ | ◎ | ◎ | 303 | 0.0449 | 20.5 |
| 23 | ◎ | ◎ | ◎ | 297 | 0.0434 | 23.2 |
| 24 | ◎ | ◎ | ◎ | 255 | 0.0427 | 24.4 |
| 25 | ◎ | ◎ | ◎ | 245 | 0.0416 | 26.4 |
| 26 | ◎ | ◎ | ◎ | 252 | 0.0361 | 36.1 |
| 27 | ◎ | ◎ | ◎ | 246 | 0.0358 | 36.6 |
| Control | ◎ | ◎ | ◎ | 301 | 0.0565 | 0 |

As is apparent from Table 5, it was found that even if the content of calcium carbonate is as low as 10 wt %, the side stream smoke per cigarette can be reduced by the addition of a citric acid salt and the cigarette papers obtained were excellent in all characteristics including optical characteristics, burning characteristics and ash characteristics.

It was further found that when the samples have the same contents of calcium carbonate, the cigarette papers (Sample Nos. 26 to 27) having a higher basis weight than the cigarette papers (Sample No. 23), exhibit a higher side stream smoke reducing effect per cigarette.

Table 6 shows the results of experiments using cigarette papers made of pulp containing kaolin alone.

TABLE 6

| Sample No. | Filler content Kaolin (%) | Optical characteristics Brightness (%) | Optical characteristics Opacity (%) | Side stream smoke/cigarette mg/cig | Side stream smoke/cigarette Reduction rate (%) | Burning time (sec.) | Side stream smoke/sec. mg/sec | Side stream smoke/sec. Reduction rate (%) |
|---|---|---|---|---|---|---|---|---|
| 28 | 0 | 79 | 59 | 11.6 | 31.4 | 541 | 79 | 59 |
| 29 | 3 | 79 | 61 | 10.9 | 35.5 | 520 | 79 | 61 |
| 30 | 5 | 80 | 63 | 10.5 | 37.9 | 498 | 80 | 63 |
| 31 | 10 | 83 | 68 | 10.0 | 40.8 | 477 | 83 | 68 |
| 32 | 20 | 84 | 70 | 11.0 | 34.9 | 438 | 84 | 70 |
| 33 | 30 | 85 | 71 | 11.7 | 30.8 | 415 | 85 | 71 |
| Control | — | 86 | 80 | 16.9 | — | 299 | 86 | 80 |

As is apparent from Table 6, the amounts of the side stream of Sample Nos. 29 to 32 containing 3 to 20 wt % of kaolin were smaller than that of Sample No. 28 containing no kaolin. The side stream smoke reducing effect was high in Sample Nos. 29 to 32. The amount of side stream smoke per cigarette and the side stream smoke reducing rate of Sample 33 containing 30 wt % of kaolin were almost equal to those of Sample 28 containing no kaolin.

Cigarette papers of Sample Nos. 29 to 33 containing kaolin were more excellent in optical characteristics than the paper of Sample 28 containing no kaolin.

It was further found that as the kaolin content increased, the burning time decreased.

From the aforementioned results, it was demonstrated that the side stream smoke reducing effect intrinsic to pulp (Sample No. 28) can be maintained or improved by adding kaolin. Furthermore, it was demonstrated that optical characteristics and burning characteristics can be improved.

Table 7 shows the results of experiments using the cigarette papers containing a chemical additive and kaolin.

TABLE 7

| Sample No. | Filler content Kaolin (%) | Citric acid salt content (%) | Side stream smoke/cigarette mg/cig | Side stream smoke/cigarette Reduction rate (%) | Burning time (sec.) |
|---|---|---|---|---|---|
| 30 | 5 | 0 | 10.5 | 37.9 | 498 |
| 30-1 | | 1 | 7.5 | 55.6 | 493 |
| 30-2 | | 4 | 7.4 | 56.2 | 473 |
| 30-3 | | 8 | 8.5 | 49.7 | 424 |
| 31 | 10 | 0 | 10.0 | 40.8 | 477 |
| 31-1 | | 0.3 | 9.3 | 45.0 | 499 |
| 31-2 | | 0.6 | 8.6 | 49.1 | 476 |
| 31-3 | | 1.0 | 7.5 | 55.6 | 486 |
| 31-4 | | 2.0 | 7.4 | 56.2 | 506 |
| 31-5 | | 4.0 | 7.2 | 57.4 | 485 |
| 31-6 | | 6.0 | 7.2 | 57.4 | 460 |
| 31-7 | | 8.0 | 7.4 | 56.2 | 418 |
| 31-8 | | 10.0 | 7.4 | 56.2 | 404 |
| 33 | 30 | 0 | 11.7 | 30.8 | 415 |
| 33-1 | | 1 | 8.3 | 50.9 | 357 |
| 33-2 | | 4 | 7.3 | 56.8 | 391 |
| 33-3 | | 8 | 7.3 | 56.8 | 401 |
| Control | — | — | 16.9 | — | 299 |

As is apparent from Table 7, in the case of cigarette papers of Sample Nos. 31-1 to 31-8 containing 10 wt % of kaolin and 0.3 to 10 wt % of a citric acid salt, the amount of the side stream smoke per cigarette was smaller and the reducing rate of the side stream per cigarette was higher than those of Sample No. 31 (no citric acid salt) and those of Sample No. 28 (no kaolin and a citric acid salt).

The cases of Sample Nos. 30-1 to 30-3, 33-1 to 33-3 containing 5 wt % to 30 wt % of kaolin and a citric acid salt exhibited the same results as above.

From the aforementioned results, it was confirmed that the side stream smoke reducing effect per cigarette can be obtained in the case where kaolin and a citric acid salt are used together. The burning time of the cigarette paper containing both kaolin and citric acid salt was shorter than that of the cigarette paper of Sample No. 28 containing neither kaolin nor a citric acid salt. Therefore, it was confirmed that the burning characteristics are improved when kaolin and a citric acid salt are used together.

Table 8 shows the results of experiments using the cigarette papers containing kaolin, calcined clay, and a chemical additive.

TABLE 8

| Sample No. | Filler content Kaolin (%) | Filler content Calcined clay (%) | Citric acid salt (Na, K) content (%) | Optical characteristics Opacity (%) | Optical characteristics Brightness (%) |
|---|---|---|---|---|---|
| 28 | 0 | 0 | 0 | 59 | 79 |
| 34a | 10 | 0 | 0 | 68 | 83 |
| 34b | | | 2 | 68 | 83 |
| 35a | 10 | 10 | 0 | 79 | 86 |
| 35b | | | 2 | 79 | 86 |
| 36a | 10 | 20 | 0 | 84 | 88 |
| 36b | | | 2 | 84 | 88 |
| 37a | 10 | 30 | 0 | 87 | 88 |
| 37b | | | 2 | 87 | 88 |
| Control | — | — | 1.2 | 80 | 86 |

| Sample No. | Side stream smoke/cigarette mg/cig | Side stream smoke/cigarette Reduction rate (%) | Burning time (sec.) | Ash characteristics Adhesion | Ash characteristics Whiteness | Side stream smoke/sec. mg/sec | Side stream smoke/sec. Reduction rate (%) |
|---|---|---|---|---|---|---|---|
| 28 | 11.6 | 31.4 | 541 | x | x | 0.0214 | 62.1 |
| 34a | 11.0 | 34.9 | 482 | Δ | x | 0.0228 | 59.6 |
| 34b | 6.7 | 60.4 | 472 | ○ | x | 0.0142 | 74.9 |
| 35a | 13.2 | 21.9 | 362 | Δ | Δ | 0.0365 | 35.4 |
| 35b | 9.8 | 42.0 | 361 | ○ | Δ | 0.0271 | 52.0 |
| 36a | 15.3 | 9.5 | 341 | Δ | Δ | 0.0449 | 20.5 |
| 36b | 9.5 | 43.8 | 305 | ○ | ○ | 0.0311 | 45.0 |
| 37a | 15.3 | 9.5 | 312 | Δ | ○ | 0.0490 | 13.3 |
| 37b | 11.7 | 30.8 | 295 | ○ | ○ | 0.0397 | 29.7 |
| Control | 16.9 | 0 | 299 | ○ | ○ | 0.0565 | 0 |

As is apparent from Table 8, in the cases of Sample No. 35*a*, 35*b*, 36*a*, 36*b*, 37*a*, 37*b*, containing 10 wt % of kaolin and 10, 20 and 30 wt % of calcined clay, the optical characteristics, burning characteristics and ash characteristics were remarkably improved, compared to the case of Sample No. 28 made of pulp alone without kaolin and the case of Sample No. 34*a* containing 10 wt % of kaolin. In particular, the opacity, burning characteristics and whiteness of ash were greatly improved as the content of calcined clay increased.

In the cases of Sample Nos. 35*a*, 36*a*, *and* 37*a* containing 10 wt % of kaolin, 10, 20 and 30 wt % of calcined clay, and no citric acid salt, the side stream smoke reducing effect was smaller than that of Sample No. 28 made of only pulp without kaolin and that of sample No. 34*a* containing kaolin (10 wt %).

On the other hand, the side stream smoke reducing effect of Samples 35*b*, 36*b*, and 37*b* containing a citric acid, was smaller than that of Sample 34*b* containing only 10 wt % of kaolin, but larger than or equal to that of sample 28 made of pulp alone with no kaolin.

From the results mentioned above, it was found that the optical characteristics and ash characteristics can be improved by using kaolin and calcined clay. Furthermore, it was demonstrated that by adding a chemical additive consisting of an alkaline metal salt to the cigarette paper containing kaolin and calcined clay, the side stream smoke reducing effect intrinsic to Sample No. 28 made of pulp alone can be maintained or improved.

Table 9 shows the results of experiments using cigarette papers containing calcium carbonate, calcined clay, kaolin and a citric acid salt. The content of kaolin was varied within the range of 3 to 10 wt %. The content of calcium carbonate was 30 wt %. The content of calcined clay was 10 wt %. The addition amount of the citric acid salt was 0, 2, and 4 wt %.

As is apparent from table 9, in Sample Nos. 39, 40 and 41 containing calcium carbonate, calcined clay and kaolin, the amount of the side stream smoke was reduced. The cigarette papers obtained were excellent in all characteristics including optical characteristics, burning characteristics, and ash characteristics. Furthermore, it was found that in Sample Nos. 39, 40 and 41, the side stream smoke reducing effect per cigarette is maintained or improved, compared to Sample No. 38 containing calcium carbonate, calcined clay, and no kaolin. Furthermore, it was demonstrated that since burning time of these samples are longer than Sample No. 38, visible side stream smoke, that is, the amount of the side stream smoke per unit time can be reduced more than that of Sample No. 38.

The same results were observed in both cases with and without a citric acid salt. In particular, when a citric acid was added, the side stream smoke reducing effect per unit time was outstanding.

Table 10 shows the results of experiments using cigarette papers made of linen pulp having a beating degree within the range of 64 to 82 ml in terms of modified Canadian standard freeness (1 g wire method) and containing 30 wt % of calcium carbonate, 10 wt % of calcined clay, 3 wt % of kaolin, and a 0 or 2% of citric acid salt.

TABLE 9

| | Basis | Filler content (%) | | | Citric acid salt | Optical characteristics | |
|---|---|---|---|---|---|---|---|
| Sample No. | weight ($g/cm^2$) | Calcium Carbonate | Calcined Clay | Kaolin | content (%) | Brightness (%) | Opacity (%) |
| 38a | 45.0 | 30.0 | 10.0 | 0.0 | 0.0 | 84 | 87 |
| 38b | | | | | 2.0 | 84 | 87 |
| 38c | | | | | 4.0 | 84 | 87 |
| 39a | 45.0 | 30.0 | 10.0 | 3.0 | 0.0 | 84 | 87 |
| 39b | | | | | 2.0 | 84 | 87 |
| 39c | | | | | 4.0 | 84 | 87 |
| 40a | 45.0 | 30.0 | 10.0 | 5.0 | 0.0 | 85 | 88 |
| 40b | | | | | 2.0 | 85 | 88 |
| 40c | | | | | 4.0 | 85 | 88 |
| 41a | 45.0 | 30.0 | 10.0 | 10.0 | 0.0 | 85 | 88 |
| 41b | | | | | 2.0 | 85 | 88 |
| 41c | | | | | 4.0 | 85 | 88 |
| Control | 21.0 | 26.0 | 0 | 0 | 1.2 | 86 | 80 |

| | Side stream smoke/cigarette | | Burning | Side stream smoke/sec. | | Ash characteristics | |
|---|---|---|---|---|---|---|---|
| Sample No. | mg/cig | Reduction rate (%) | time (sec.) | $\times 10^{-2}$ mg/sec | Reduction rate (%) | White-ness | Adhesion |
| 38a | 11.1 | 34.3 | 306 | 3.63 | 35.8 | ◎ | ◎ |
| 38b | 9.1 | 45.0 | 287 | 3.24 | 42.7 | ◎ | ◎ |
| 38c | 8.3 | 50.7 | 260 | 3.19 | 43.5 | ◎ | ◎ |
| 39a | 11.5 | 32.6 | 345 | 3.31 | 41.1 | ◎ | ◎ |
| 39b | 9.7 | 42.6 | 337 | 2.88 | 49.0 | ◎ | ◎ |
| 39c | 8.4 | 50.3 | 303 | 2.77 | 51.0 | ◎ | ◎ |
| 40a | 11.7 | 30.8 | 354 | 3.31 | 41.4 | ○ | ◎ |
| 40b | 9.4 | 44.4 | 362 | 2.60 | 54.0 | ○ | ◎ |
| 40c | 8.0 | 52.7 | 314 | 2.55 | 54.9 | ◎ | ◎ |
| 41a | 10.9 | 35.5 | 366 | 2.98 | 47.3 | ○ | ◎ |
| 41b | 8.4 | 50.3 | 398 | 2.11 | 65.7 | ○ | ◎ |
| 41c | 7.5 | 55.6 | 368 | 2.04 | 63.9 | ○ | ◎ |
| Control | 16.9 | 0 | 299 | 5.65 | 0 | ◎ | ◎ |

TABLE 10

| Sample No. | Modified Canadian standard freeness (CSF) | Basis weight ($g/m^2$) | Filler content (%) Calcium Carbonate | Calcined clay | Kaolin | Citric acid salt content (%) |
|---|---|---|---|---|---|---|
| 42a | 82 | 45 | 30 | 10 | 3 | 0 |
| 42b | | | | | | 2 |
| 43a | 73 | 45 | 30 | 10 | 3 | 0 |
| 43b | | | | | | 2 |
| 44a | 64 | 45 | 30 | 10 | 3 | 0 |
| 44b | | | | | | 2 |
| Control | — | 21 | 26 | 0 | 0 | 1.2 |

| Sample No. | Side stream smoke/cigarette mg/cig | Reduction rate (%) | Side stream smoke/sec. mg/sec | Reduction rate (%) | Burning time (sec.) |
|---|---|---|---|---|---|
| 42a | 12.3 | 27.0 | 0.0360 | 36.4 | 366 |
| 42b | 10.2 | 39.6 | 0.0279 | 50.5 | |
| 43a | 12.1 | 28.2 | 0.0344 | 39.1 | 384 |
| 43b | 9.3 | 45.0 | 0.0242 | 57.3 | |
| 44a | 11.4 | 32.7 | 0.0300 | 47.0 | 402 |
| 44b | 8.9 | 47.5 | 0.0221 | 60.9 | |
| Control | 16.9 | — | 0.0565 | — | — |

As is apparent from Table 10, it was found that as the beating degree is larger, in other words, the modified Canadian standard freeness is lower, the amounts of the side stream smoke per cigarette and per unit time decrease.

What is claimed is:

1. Cigarette paper for a smoking article comprising:

10 to 60% by weight of calcium carbonate particles having a particle size of from 0.03 to 0.15 $\mu$m;

5 to 30% by weight of calcined clay;

0.5 to 10% by weight of a chemical additive comprising an alkaline metal salt; and pulp.

2. Cigarette paper for rolling a smoking article comprising:

2 to 30% by weight of kaolin;

5 to 30% by weight of calcined clay;

0.3 to 10% by weight of a chemical additive comprising an alkaline metal salt; and pulp.

3. Cigarette paper for a smoking article comprising:

10 to 60% by weight of calcium carbonate particles having a particle size of from 0.03 to 0.15 $\mu$m;

5 to 30% by weight of calcined clay;

2 to 10% by weight of kaolin;

0.5 to 10% by weight of a chemical additive comprising an alkaline metal salt; and pulp.

4. The cigarette paper for a smoking article according to claim 1, wherein a basis weight of said paper is 50 to 70 $g/m^2$.

5. The cigarette paper for a smoking article according to claim 2, wherein a basis weight of said paper is 50 to 70 $g/m^2$.

6. The cigarette paper for a smoking article according to claim 3, wherein a basis weight of said paper is 50 to 70 $g/m^2$.

7. The cigarette paper for a smoking article according to claim 1, wherein a basis weight of said paper is 20 to 70 $g/m^2$.

8. The cigarette paper for a smoking article according to claim 1, wherein said alkaline metal salt is selected from the group consisting of sodium salts and potassium salts of carbonic acid, formic acid, acetic acid, propionic acid, malic acid, lactic acid, glycolic acid, citric acid, tartaric acid, fumaric acid, succinic acid, oxalic acid, malonic acid and phosphoric acid.

9. The cigarette paper for a smoking article according to claim 2, wherein a basis weight of said paper is 20 to 70 $g/m^2$.

10. The cigarette paper for a smoking article according to claim 2, wherein said alkaline metal salt is selected from the group consisting of sodium salts and potassium salts of carbonic acid, formic acid, acetic acid, propionic acid, malic acid, lactic acid, glycolic acid, citric acid, tartaric acid, fumaric acid, succinic acid, oxalic acid, malonic acid and phosphoric acid.

11. The cigarette paper for a smoking article according to claim 3, wherein a basis weight of said paper is 20 to 70 $g/m^2$.

12. The cigarette paper for a smoking article according to claim 3, wherein said alkaline metal salt is selected from the group consisting of sodium salts and potassium salts of carbonic acid, formic acid, acetic acid, propionic acid, malic acid, lactic acid, glycolic acid, citric acid, tartaric acid, fumaric acid, succinic acid, oxalic acid, malonic acid and phosphoric acid.

* * * * *